US007793761B2

(12) United States Patent
Oberer

(10) Patent No.: US 7,793,761 B2
(45) Date of Patent: Sep. 14, 2010

(54) ELEVATOR CAR LIGHTING EQUIPMENT FOR GUIDANCE OF PERSONS

(75) Inventor: Alex Oberer, Ennetburgen (CH)

(73) Assignee: Inventio AG, Hergiswil NW (CH)

( * ) Notice: Subject to any disclaimer, the term of this patent is extended or adjusted under 35 U.S.C. 154(b) by 601 days.

(21) Appl. No.: 11/740,338

(22) Filed: Apr. 26, 2007

(65) Prior Publication Data

US 2007/0251766 A1 Nov. 1, 2007

(30) Foreign Application Priority Data

Apr. 28, 2006 (EP) ..... 06113306

(51) Int. Cl.
*B66B 1/34* (2006.01)

(52) U.S. Cl. ..... 187/391; 187/396

(58) Field of Classification Search ..... 187/247, 187/391–396

See application file for complete search history.

(56) References Cited

U.S. PATENT DOCUMENTS 5,485,897 A 1/1996 Matsumoto et al.
5,559,681 A 9/1996 Duarte
6,394,231 B1 * 5/2002 Schuster et al. ..... 187/382
6,550,587 B1 * 4/2003 Yuasa et al. ..... 187/394
7,322,446 B2 * 1/2008 Terry et al. ..... 187/391
7,591,348 B2 * 9/2009 Takeuchi ..... 187/391
2001/0035314 A1 * 11/2001 Yoshida et al. ..... 187/382
2002/0125839 A1 9/2002 Yen

FOREIGN PATENT DOCUMENTS

JP 06064854 A * 3/1994
JP 06 223976 A 8/1994
JP 09-286571 11/1997
WO WO 2004/022470 A1 3/2004
WO WO 2005/042390 A1 5/2005

* cited by examiner

*Primary Examiner*—Jonathan Salata
(74) *Attorney, Agent, or Firm*—Fraser Clemens Martin & Miller LLC; William J. Clemens

(57) ABSTRACT

Lighting equipment of an elevator car and a method for guidance of persons in an elevator provides a floor indication that communicates to the passenger, in a simple and clear manner, reaching of his or her destination floor, even in high buildings with numerous floors. The lighting equipment has a light source and a control of the light source, which produces a color effect relative to the floor indication.

17 Claims, 4 Drawing Sheets

ELEVATOR CAR LIGHTING EQUIPMENT FOR GUIDANCE OF PERSONS

FIELD OF THE INVENTION

The present invention relates to lighting equipment of an elevator car and to a method for guidance of persons in an elevator.

BACKGROUND OF THE INVENTION

An elevator consists of at least one elevator car, which transports passengers as desired to different floors of a building. A passenger can reach and also leave again the elevator car by at least one car door. A basic component of the elevator car is the lighting equipment. The original function of the lighting equipment is lighting the elevator car in the presence of a passenger.

According to European elevator specifications (EN 81-1: 1998, 17.1.1) the elevator car must have permanently installed electric lighting equipment ensuring a lighting intensity of at least 50 lux at the floor and at the command transmitters. In addition, it is required (EN 81-1:1998, 15.9) that visible references or floor indications make it possible for the passenger in the elevator car to recognize the floor at which the elevator car has stopped.

Indication of the instantaneous floor position is, then, important for the passenger. During the journey the attention of the passenger is oriented towards reaching his or her destination floor at which he or she wishes to leave the elevator car again so as to be able to pursue his or her intended activity. Conventional solutions of the floor indication fulfil this function by means of illuminated text displays, acoustic signals, button displays, image screen displays and further systems which can communicate visual or acoustic data with respect to the floor position.

A disadvantage of the above-mentioned solutions is the requirement that the passenger must, during the entire journey, concentrate on the floor indication or that he or she, with only an acoustic signal, cannot make a clear association with the destination floor. The disadvantages have an especially negative effect particularly in buildings with numerous floors, for example with 50 and more floors, since the passenger is located in the elevator car for a longer period of time and has to concentrate on the floor indication during this time.

SUMMARY OF THE INVENTION

An object of the present invention is provision of a floor indication for the passenger and a method for guidance of persons, which communicates to the passenger, in simple and clear manner, reaching his or her destination floor, even in high buildings with numerous floors.

The lighting equipment, in accordance with the present invention, of an elevator car has a light source and a control of the light source, which produces a color effect for the floor indication. This lighting equipment is also a component of a method for guidance of persons in an elevator with an elevator car.

The advantage of this lighting equipment resides in the communication of the destination floor by means of the color effect of the lighting equipment. Accordingly, there is predetermined for the passenger by the lighting equipment a color profile which facilitates, for the passenger, orientation in the building. The color profile comprises a sequence of several color effects and is distinguished by the fact that a floor is advantageously characterized, in accordance with this sequence, by a clear, floor-specific color effect. This color effect can be produced by lighting up of a color, of a color combination or time-dynamic color settings such as flashing or pulsing.

The setting of the color profile can be carried out in accordance with different criteria, such as floor colors which are actually present, theme-communicating or ambience-communicating associations, business or cultural color codes or simply in accordance with individual or mutual preferences. Further examples of color codings are conceivable. However, it is common to all these color profiles that a passenger recognizes intuitively and simply when he or she has reached the desired destination floor and thus knows at which point in time he or she must leave the elevator car.

Further advantages of the lighting equipment according to the present invention follow. Since the lighting equipment is a fixed component of each elevator car, thanks to the floor indication by lighting equipment additional floor indicating devices are superfluous and thus the costs of an elevator system reduced. Equally, the passenger has pleasure in using his or her elevator thanks to the individually settable color effects.

The lighting equipment preferably additionally has a terminal, wherein the control of the light source comprises at least one processor and at least one memory unit. The control can program the light source by way of the terminal. The terminal can be selectably realized by a keyboard, a touch screen or any man/machine interface, which allows programming of the control.

The last-mentioned lighting equipment is also a component of a method comprising the following steps: (a) the control is programmed by means of the terminal in accordance with a color profile, (b) the color profile is stored in the memory unit of the control and (c) the control controls the light source in accordance with the color profile.

If the lighting equipment has a programmable control, several advantages result. The color profile can be easily changed, which in the case of conference floors with alternating use can be of advantage (cf. for this purpose examples under "color profiles"). In addition, it is also frequently necessary or helpful if persons without elevator-specific instruction are capable of creating or changing such a color profile. In this case a simple programming of the control of the light source is of substantial usefulness. Moreover, it is also conceivable for updates with current color effects to be loaded on the control by way of such an interface, as is offered by a terminal with a computer. In the case of a modular mode of construction of the lighting equipment it is also possible for individual components such as, for example, the terminal to take into account the latest technical developments and to provide these in simple manner.

In an alternative form of embodiment the lighting equipment has a color sensor which, instead of the terminal, sets the color profile in the control. The color sensor detects a floor color physically present in the floor and sets the color effect for the floor indication by way of control of the light source. This lighting equipment is also a component of a method comprising the following steps: (a) a color profile is transmitted to the control by means of the color sensor and (b) the control controls the light source in accordance with the color profile.

The control of the light source, which has at least one processor or at least one memory unit, can preferably be programmed by the color sensor. One or more color sensors can be positioned on the elevator car itself or on the floors.

The color sensor is preferably so positioned in the door region of the elevator car that it looks directly or indirectly into the elevator lobby.

The principal advantage of lighting equipment with a color sensor is that the color profile is automatically set by the color sensor. Manual programming of the control of the light source is thereby redundant. It is selectably possible to discern the advantage of a minimum number of color sensors, which are to be installed, by the positioning of the color sensor on the elevator car or the advantage of integration of the sensors in an already existing building information system by positioning of sensors on the floors, in order to produce the connection between color sensors and the control of the light source.

An important aspect of the invention is communication of the floor-specific color effect by a color effect display before the passenger uses the elevator, so that the passenger recognizes with reliability when he or she has reached his or her destination floor.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
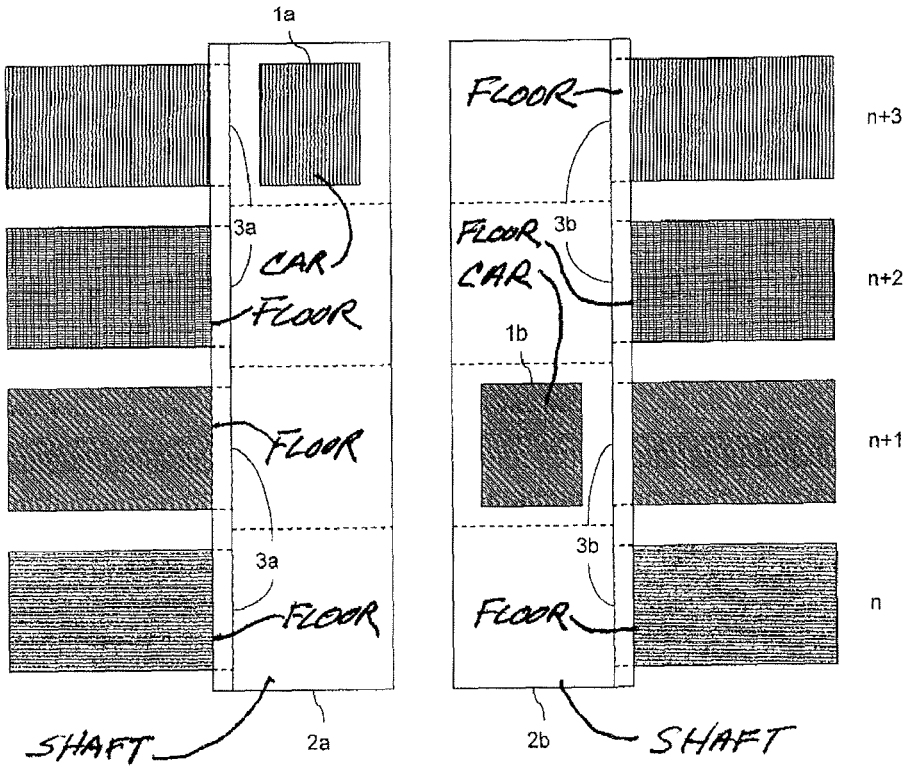
FIG. 1 is an example of a color profile which is oriented towards the color characteristic of the floors in a building with at least n+3 floors and the lighting equipment as guidance for persons.

In many public buildings the floors are characterized by different colors. For example, it is usual to design the floors to be color-specific in parking buildings. FIG. 1 shows a building with "n+3" floors and an elevator installation having two elevator shafts 2*a*, 2*b* each with a respective elevator car 1*a*, 1*b*. Each of these floors is characterized by a specific color: floor "n" by blue, floor "n+1" by green, floor "n+2" by yellow and floor "n+3" by red. In the illustrated case the lighting equipment 9 (FIG. 2) of the elevator car 1*b* has signaled to the passenger, who has parked his or her car at the green level (floor "n+1") and wants to go back to the car, his or her destination floor by a green illumination color. Similar examples can be realized in hospital buildings or in other buildings with physically pronounced color profiles of the building floors.

Figure 2:
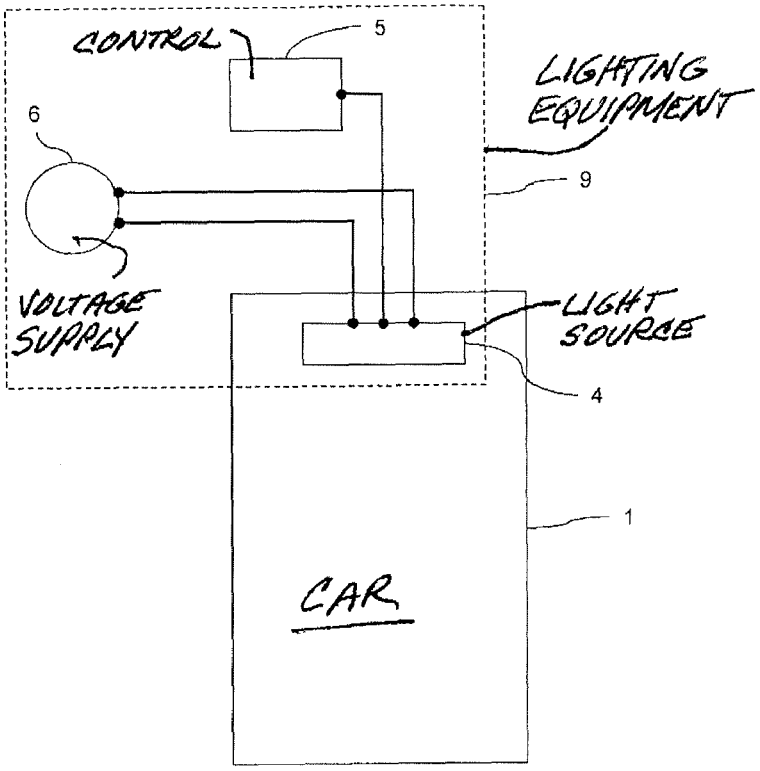
FIG. 2 is a schematic basic configuration of an embodiment of a portion of lighting equipment according to the present invention for an elevator car.

The basic configuration of the lighting equipment 9 according to the present invention is shown in FIG. 2. It is composed of a light source 4 of an elevator car 1, a control 5 of the light source 4 and a voltage supply 6 of the light source 4. Production of the color effects of the light source 4 is controlled by the control 5 and the supply voltage 6 supplies the light source with electrical energy.

Figure 3:
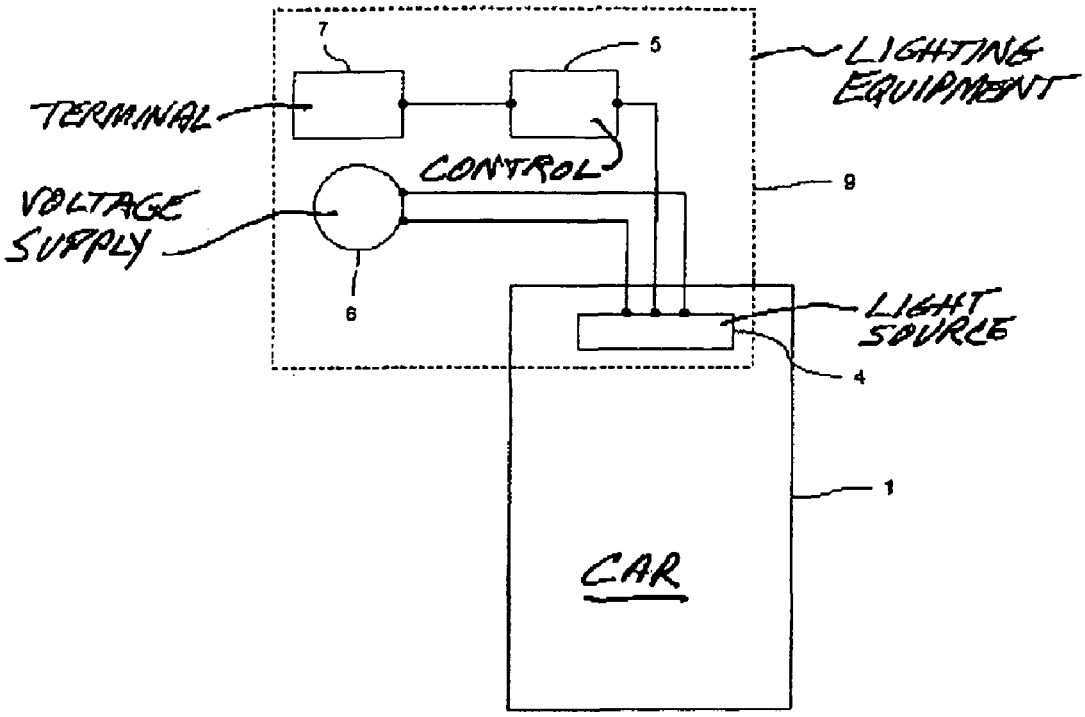
FIG. 3 is a schematic basic configuration of a second embodiment of a portion of lighting equipment according to the present invention for an elevator car with a terminal for input of the programming of the color profile.
Figure 4:
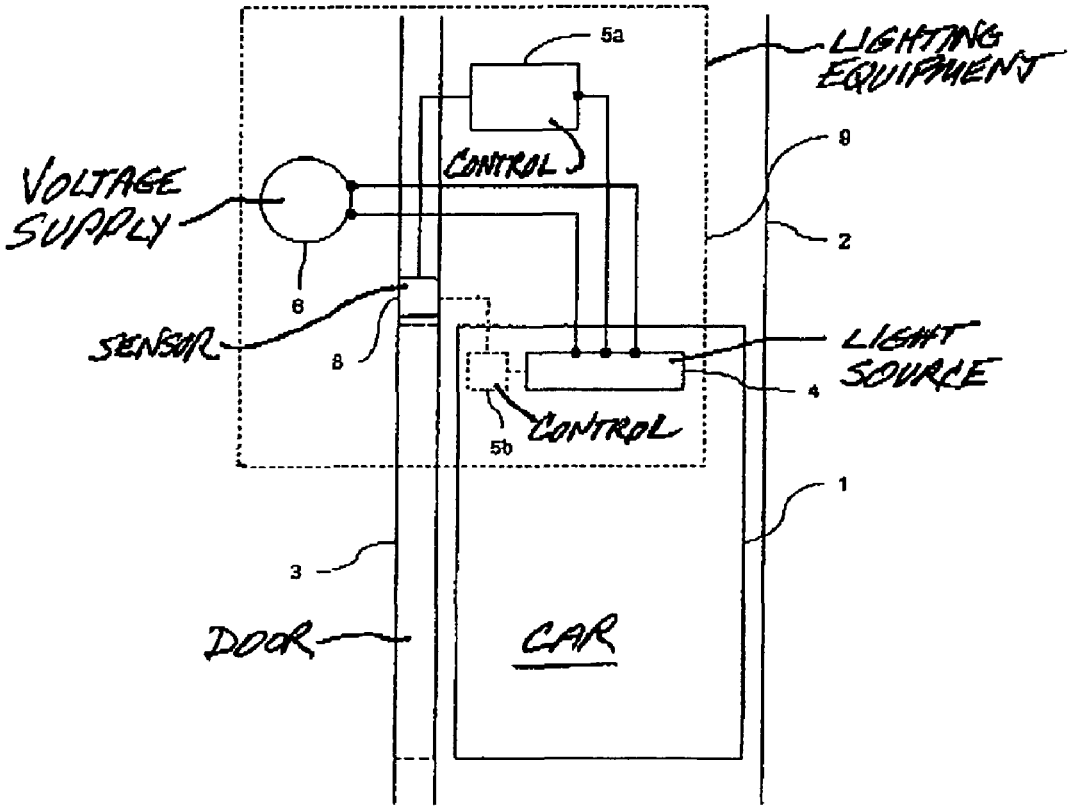
FIG. 4 is a schematic basic configuration of a third embodiment of a portion of lighting equipment according to the present invention for an elevator car with a sensor for fixing the color profile.

In FIG. 3 a terminal 7 is additionally added to the basic configuration. The terminal 7 serves as an input device of input codes which are transmitted to the control as command signals and serve for programming the color profile. In another form of embodiment the color profile can, according to FIG. 4, also be used by a color sensor 8 which is preferably located in the door region, recognizes building floor colors and communicates these as sensor data to the control 5*a*, 5*b*.

Figure 5:
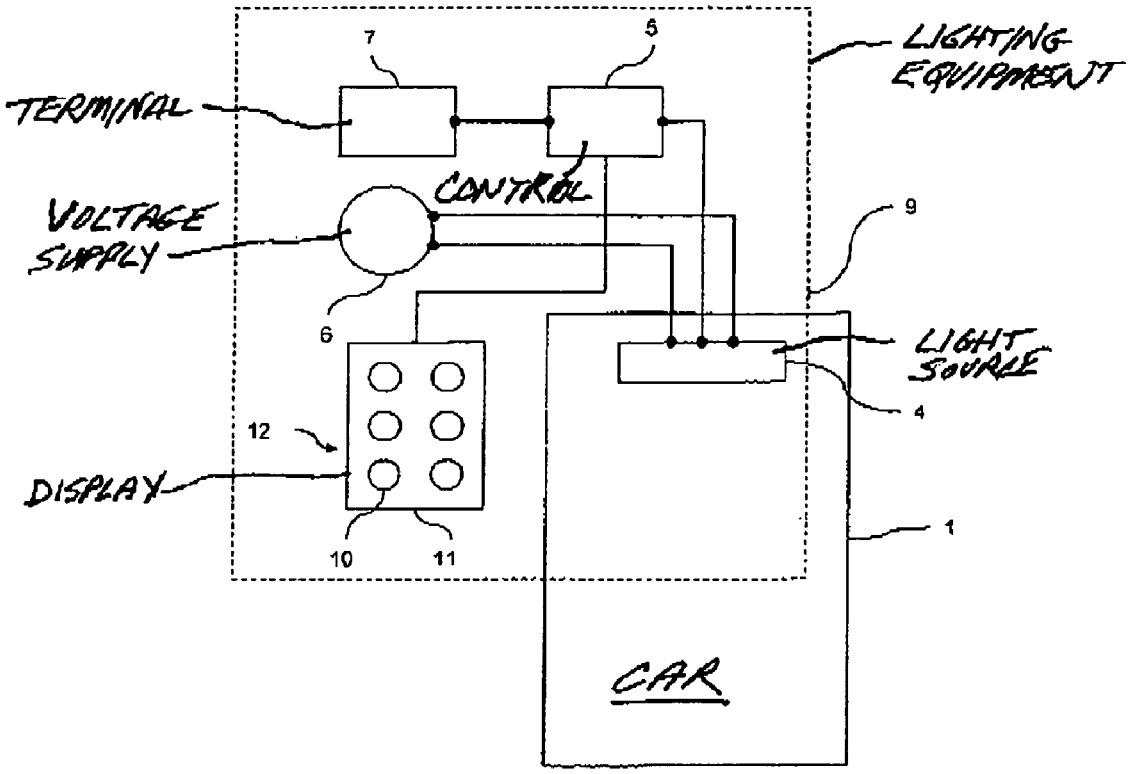
FIG. 5 is a schematic basic configuration of a fourth embodiment of lighting equipment according to the present invention for an elevator car with a color effect display for communication of the destination floor color effect prior to the elevator journey.

In FIG. 5 a color effect display 12 is additionally added to the lighting configuration of FIG. 3. The color effect display shows to the passenger, on selection of his or her destination floor, which color effect is allocated to this destination floor in accordance with the color profile. It is thus available to the passenger to recognize, before starting the elevator journey, by way of the necessary information his or her destination floor on the basis of the color effect of the lighting equipment 9.

Figure 6:
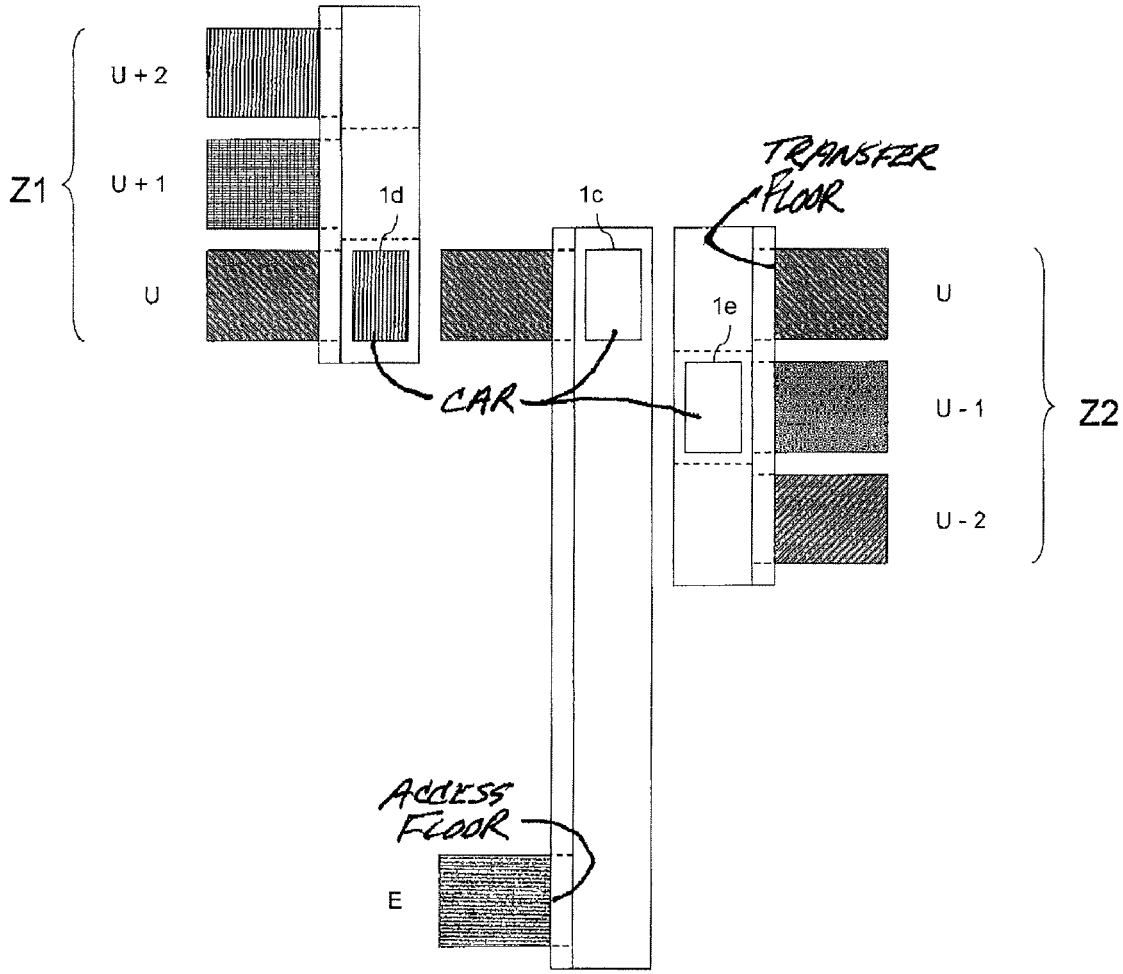
FIG. 6 is an example of a color profile in a building with at least one transfer floor, at least two floor zones and the lighting equipment as guidance for persons in one of these transfer floors.

FIG. 6 shows the lighting equipment 9 as guidance for persons in a transfer floor U of a building with numerous floors. In such buildings it is usual for transfer floors U to be defined, which ensure the connection between the building access floors E and floors lying in floor zones Z1, Z2. On leaving the elevator car 1*c* of a shuttle elevator the lighting equipment 9 of a waiting elevator car 1*d*, 1*e* offers to the passenger an orientation aid for finding the elevator car 1*d* provided for onward travel. The lighting equipment 9 of the waiting elevator car 1*d* signals to the passenger the color effect of his or her destination floor and in that case assists the passenger to find the elevator car 1*d* for the further travel.

Color Profile

The color profile is defined by a sequence of preferably floor-specific color effects. Thus, each building usually has its own color profile. The color profile can be undertaken in accordance with different aspects. In an obvious manner the color profile is predetermined by the physical formation of floor colors, as was already shown in the example of FIG. 1.

Apart from the floor colors as a variable determining a guidance system for persons it is also conceivable to undertake a theme-based allocation of the colors; for example, the floor of the reception is signaled in a communicative yellow-orange, that of the seminar room in intellectual blue, the floor in which the sales activity takes place in aggressive red, the floor at which the pub is located, which regularly transmits football games live, in green or the floor in which the conference of the guest group is held in the corporate colors thereof. The last-mentioned color shows that it also entirely makes sense to use color combinations.

A further aspect of the present invention relates to the setting of the floor color by ambience-communicating colors. Thus, the coloration of the car lighting can be set on the basis of association of ambience and floor characteristic, such as is predetermined by a restaurant, sports training center, wellbeing haven or discotheque. For example, the lighting equipment 9 could communicate reaching the floor with a discotheque by rhythmically pulsating bright color tones, the wellbeing haven would be announced by calming red-brown color tones, the restaurant greets its guests in a tasteful Bordeaux red and the training center places its visitors in the mood for the next training lesson by an animating yellow.

Color codes, which can be utilized for the design of the color profile, have been developed in different cultures and businesses. In the western culture, gender-specific floors, such as could occur in, for example, a sauna with gender-separated areas, could be characterized by blue or red. Female sauna visitors would correspondingly recognize the floor of their sauna region at the red lighting color and male sauna users would recognize their floor in the blue lighting color. Numerous further coloration examples from different cultural and business circles are conceivable here.

The color profile of the lighting equipment 9 can obviously also be set in accordance with purely subjectively, individually or mutually undertaken color preferences. This is clarified by the following color profile in a residential building: Mr. Müller in the penthouse prefers the color green, the Schneider family agrees on orange and Mrs. Schmitt would like to be able to indicate her floor stop by pink.

Light Source

Numerous technologies are known for producing different lighting colors: light-emitting diodes, halogen lamps, fluorescent tubes or color filters. The present invention is not confined to a specific form of light generation or coloration of the light. Light-emitting diodes are particularly suitable. Light-emitting diodes have a number of advantages, which are useful particularly in elevator car construction in conjunction with the present invention.

An important advantage of light-emitting diodes in conjunction with the present invention is the possibility of reproducing the entire color spectrum by means of RGB control in the visible wavelength range of 380-740 nm. This functionality enables substantial freedom in the design of the color profile. Desired colors such as, for example, red (625-740 nm), orange (590-625 nm), yellow (565-590 nm), green (520-565 nm), cyan (500-520 nm), blue (450-500 nm), indigo (430-450 nm) and violet (380-430 nm) can be easily set.

Low energy costs and a long service life have an advantageous effect on operating costs of such lighting equipment 9 and thus contribute to lower operating costs of the elevator installation. The compact mode of construction of light-emitting diodes additionally takes into account the increasing value placed on car design and makes possible substantial design freedoms. In addition, light-emitting diodes are distinguished by a low temperature development and insensitivity with respect to vibrations and shocks.

The positioning of the light source 4 in the elevator car 1 is not restricted to any specific preconditions and can be freely selected. Thus, the light source can be positioned at the car ceiling, side wall, floor, in the corners or edges, and in the door or control-panel area. In particular, a combination of the keyboard lighting with the car lighting is conceivable, in which the keyboard lighting is incorporated for producing the lighting effect.

The light source 4 can be composed of numerous individual part light sources and consist of part light sources of different lighting technologies. Individual part light sources can thus form a part region of the light source. In that connection it is also conceivable for only a part region of the light source 4 to produce the color effect for the floor indication. Thus, a part region of the light source 4 can be designed as indirect lighting of the elevator car 1 and, for example, illuminate the control panel by means of spotlight. It is possible in such a combination to produce the color effect only by the spotlight and leave the rest of the light source 4 in white light when the color effect is produced. Analogously to the stated example, many different forms of embodiment can be devised in which only a part region of the light source 4 generates the color effect.

Control of the Light Source

The control 5 of the light source 4 comprises a processor and a memory unit and is thus programmable. The memory unit stores, for example, the color profile as a bit pattern. The processor reads this bit pattern and generates, on the basis of the instantaneous elevator car position, a control signal for the light source 4. The light source 4 in turn sets a color effect in accordance with the control signal. In that case the control 5 for producing the color effect can also control only a part region of the light source 4.

The control 5 of the light source 9 is typically carried out by way of the elevator control, but a separate control can also be provided. The elevator control calculates by way of position detecting means, which, for example, detect shaft data, angle revolutions of an elevator drive or distance data, the instantaneous position of the elevator car 1. The lighting equipment 9 can correspondingly set the color effect in accordance with a predetermined color profile on reaching a specific floor and signal to the passenger the attainment of his or her destination floor.

It is also conceivable, particularly in combination with the color sensor 8 for the control 5*b* of the light source 4 to be locally positioned on the elevator car 1 and to undertake setting of the color profile in dependence on or independently of the elevator control 5*b*. The control commands for producing the color effects are in this case generated on the basis of communicated color sensor data.

Terminal for Programming the Control

An important function of the lighting equipment 9 is programming of the color profile. This is carried out by way of a man/machine interface, here termed the terminal 7. In that case the terminal 7 communicates digital or analog command signals to the control 5 of the light source 4 on the basis of input codes. This terminal can be realized in different forms of embodiment.

In a first form of embodiment the terminal can adopt the form of a keyboard. In that case the term "keyboard" is used in the widest sense and thus to be understood as all forms of button systems suitable for input of input codes. This keyboard can be a component of a computer, the keyboard of an elevator control panel, a mobile radiotelephone or a mobile telephone and can also embrace further forms of embodiment.

If the control of the light source can be reached in simple manner, for example if the control lies in a separate engine room, the keyboard can also be integrated in the control unit. However, forms of embodiment of terminals are also conceivable which manage without a keyboard, such as a touch screen or a microphone in co-operation with voice recognition. Further forms of embodiment of terminals without a keyboard are equally conceivable.

Color Sensor for Setting the Control

As an alternative to the terminal 7 for input of input codes, a physically constructed color profile, such as is predetermined by, for example, floor colors of the buildings, can be recognized by the color sensor 8 and corresponding sensor signals communicated to the control 5*a*, 5*b* of the lighting equipment. In that case the sensor generates sensor signals of different voltage. On the basis of the sensor signals the control 5*a*, 5*b* generates control signals determining the setting of a corresponding color effect, in this case obviously the color of the identified floor color.

An advantageous positioning of the sensor 8 is effected in the door region. If the sensor 8 is positioned behind the elevator door 3*a*, 3*b*, the color determination of the building floor is carried out only on opening the door. Modern color sensors 8 with response times in the microsecond range ensure that the floor indication by color effect of the lighting equipment takes place sufficiently promptly.

The color sensor 8 can also be so positioned that regardless of the status of the doors 3*a*, 3*b* it looks into the foyer of the floor and can communicate the floor color to the control 5*a*, 5*b* before opening of the doors 3*a*, 3*b*. In this case positioning of the color sensor outside the door region is also conceivable.

The sensor 8 can in principle be a component of the elevator car and positioned on the same. In another arrangement a respective color sensor can be mounted on each floor at a desired position and be connected, for example, by way of a building information system with the control 5 of the light source 4.

Linking of the Basic Elements of the Lighting Equipment

The communication of data between terminal 7 or color sensors 8, control 5*a*, 5*b* and light source 4 is carried out by way of a communications network. This network is formed by connecting cable or cable-free communications technologies such as infrared, Bluetooth, wireless LAN, mobile radio technologies, electromagnetic waves, NFC or light waves, solutions are also conceivable in which any combinations of the above-mentioned communications technologies are employed.

Color Effect Display

In principle it is possible that the passenger on multiple or regular use of a elevator notices a color effect of his or her destination floor or a part region of the color profile or even the entire color profile. Multiple utilization of the invention is, however, achieved when there is indication to the passenger of the color effect of his or her destination floor, prior to use of the elevator, even in the case of initial or infrequent use of the elevator or of a destination floor or simply as an aid to thinking.

The selection of the destination floor is usually carried out by way of input means such as the keyboard 11 or a touch screen. The passenger makes known his or her destination floor to the elevator control by way of this input means. This is an advantageous point in time to communicate to the passenger the color effect of his or her destination floor. The elevator control 5 thus produces the color effect of the destination floor by way of a color effect display 12. In that case the color effect display 12 typically lies in the viewing field of the passenger when the passenger undertakes the destination floor selection. In that case the color effect display 12 simultaneously acts as communication display of the color effect and as acknowledgement display of the car call. Different forms of embodiment and positions of the color effect display 12 are conceivable.

The color effect display 12 can be an integral component of the keyboard 11 of the input means. If the passenger now presses a button 10 with his or her destination floor, a button illumination which lies under the button 10 or surrounds the button 10 is activated by the control 5 and thus the color effect of the destination floor is communicated. The touch screen functions analogously thereto as input means and color effect display 12. On selection of the destination floor at least a part region of the touch screen communicates the color effect of the destination floor.

A further form of embodiment of the color effect display comprises an image screen which lies in the vicinity of the input means. On actuation of the input means the image screen produces the color effect of the destination floor. A lamp can also be provided as color effect display instead of the image screen.

In all mentioned examples distinction can fundamentally be made between two cases: an elevator with destination call control, in which the passenger communicates his or her destination floor already on calling the elevator car 1, and a elevator with a classic car call control, in which the passenger activates the destination floor selection only in the elevator car 1. The color effect display 12 is installed outside or inside the elevator car 1 depending on the respective case.

Elevator Configuration

The lighting equipment 9 according to the present invention can basically be used in any passenger elevator regardless of the configuration thereof. The invention is particularly suitable for indicating the floors in high-rise buildings, since color profiles of any length can be programmed or set by different colors, color combinations, time dynamics of the color effects, such as flashing, pulsating, change in lighting intensity or moving color transitions. It is also conceivable to wholly or partly repeat part regions of a color profile.

Transfer floors U are often defined in buildings with numerous floors. These transfer floors U are served directly by high-speed elevators from the building access floors E. After reaching the transfer floors U transfer takes place to locally operating elevator cars 1*d*, 1*e* serving predefined floor zones Z1, Z2 and thus fine distribution of passengers to the destination floors is undertaken. Accordingly, passengers who want to change from one floor zone Z1 to another floor zone Z2 or to leave the building similarly go to the transfer floor U.

The lighting equipment 9 of waiting elevator cars 1*c*, 1*d*, 1*e* advantageously display the color effect of the destination floor of the passenger arriving in the transfer floor U. A passenger going by way of the elevator car 1*c* of the high-speed elevator to the transfer floor U thus recognizes the waiting, locally operating elevator car 1*d* by way of the color effect of the lighting equipment of his or her destination floor. The destination floor indication in the transfer floor U can alternatively also be carried out by a color effect display or another device which is suitable for producing a color effect and which is positioned outside the elevator car.

In the concrete case of FIG. 5, the passenger wants to go to the floor "U+2" of the floor zone Z1, which is characterized by the color red in accordance with the color profile. The passenger reaches the transfer floor U by way of the elevator car 1*c*. The waiting elevator car 1*d* serves the destination floor "U+2" of the passenger. In order to facilitate orientation of the passenger during the transfer, the lighting equipment 9 of the elevator car 1*d* generates a red color effect during the transfer process and thus offers an orientation aid to the passenger.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. Lighting equipment for an elevator car comprising:

a light source positioned in the elevator car for viewing by a passenger for the elevator car; and a control connected to said light source for generating from said light source a plurality of color effects, each said color effect indicating an associated floor served by the elevator car when the associated floor has been reached by the elevator car wherein said color effects form a color profile of a building in which the elevator car operates.

2. The lighting equipment according to claim 1 including a terminal connected to said control, wherein said control includes at least one processor and at least one memory unit, said control being programmable by said terminal.

3. The lighting equipment according to claim 1 including at least one color sensor in communication with said control for setting said color profile.

4. The lighting equipment according to claim 3 wherein said control includes at least one processor and at least one memory unit and said control is programmable by said at least one color sensor.

5. The lighting equipment according to claim 3 wherein said at least one color sensor is positioned in a door region of said associated floor.

6. The lighting equipment according to claim 3 wherein said at least one color sensor is positioned at said associated floor or on the elevator car.

7. The lighting equipment according to claim 1 wherein said color effect is generated by at least two colors.

8. The lighting equipment according to claim 7 wherein that said color effect is generated as a time-dynamic effect.

9. The lighting equipment according to claim 1 further comprising a color effect display wherein upon selection of a destination floor by the passenger, said color effect displays said color effect associated with said destination floor.

10. Lighting equipment for an elevator car comprising:

a light source positioned for viewing by a passenger for the elevator car; and a control of said light source for generating from said light source a color effect indicating an associated floor served by the elevator car wherein said control stores a color profile having a color effect for each floor served by the elevator and including at least one color sensor in communication with said control for setting said color profile.

11. The lighting equipment according to claim 10 wherein said control includes at least one processor and at least one memory unit and said control is programmable by said at least one color sensor.

12. The lighting equipment according to claim 10 wherein said at least one color sensor is positioned in a door region of said associated floor.

13. The lighting equipment according to claim 10 wherein said at least one color sensor is positioned at said associated floor or on the elevator car.

14. A method for guidance of passengers in an elevator installation having an elevator car, a light source in the elevator car and a control for controlling the light source comprising in response to the elevator car arriving at a destination floor of a passenger in the elevator car, operating the control to generate a color effect from the light source indicating to the passenger that the elevator car has reached the destination floor, the color effect being associated only with the destination floor.

15. The method according to claim 14 including the steps of:

a. assigning a different predetermined color effect to each floor served by the elevator car to form a color profile for a building containing the floors; and b. operating the control to control the light source in accordance with the color profile to generate the floor-specific color effects.

16. The method according to claim 15 including a terminal for programming the control which includes a memory unit and a processor comprising the steps of:

c. programming the control through the terminal in accordance with the color profile; and d. storing the color profile in the memory unit of the control.

17. The method according to claim 15 including a color sensor for setting the control wherein the color sensor communicates the color profile to the control.

* * * * *